United States Patent [19]

Katayose et al.

[11] Patent Number: 4,718,380

[45] Date of Patent: Jan. 12, 1988

[54] SYSTEM AND METHOD FOR CONTROLLING THE OPENING ANGLE OF A THROTTLE VALVE ACCORDING TO THE POSITION OF AN ACCELERATOR FOR AN AUTOMOTIVE VEHICLE

[75] Inventors: Shinji Katayose, Tokyo; Minoru Tamura, Yokohama; Hideaki Inoue; Akira Takei, both of Yokosuka; Takashi Oka, Tokyo, all of Japan

[73] Assignee: Nissan Motor Company, Limited, Kanagawa, Japan

[21] Appl. No.: 849,708

[22] Filed: Apr. 9, 1986

[30] Foreign Application Priority Data

May 27, 1985 [JP] Japan ..... 60-113792
Jul. 19, 1985 [JP] Japan ..... 60-159461

[51] Int. Cl.[4] ..... F02D 11/10; F02D 9/02
[52] U.S. Cl. ..... 123/399; 123/361
[58] Field of Search ..... 123/399, 361, 352

[56] References Cited

U.S. PATENT DOCUMENTS 4,453,516 6/1984 Filsinger ..... 123/399 X
4,519,360 5/1985 Murakami ..... 123/399
4,519,361 5/1985 Murakami ..... 123/399
4,541,052 9/1985 McCulloch ..... 180/179 X
4,597,049 6/1986 Murakami ..... 123/352 X
4,612,615 9/1986 Murakami ..... 123/361 X
4,641,622 2/1987 Murakami ..... 123/585 X
4,649,880 3/1987 Asano et al. ..... 123/399

FOREIGN PATENT DOCUMENTS 126036 7/1984 Japan ..... 123/399

*Primary Examiner*—Tony M. Argenbright
*Attorney, Agent, or Firm*—Schwartz, Jeffery, Schwaab, Mack, Blumenthal & Evans

[57] ABSTRACT

A system and method for controlling the opening angle of a throttle valve installed within an engine for a vehicle, in which the rate of change of the opening angular position of the throttle valve is calculated as a substantially cubic function of a relative rate of change in an angular position of an accelerator pedal, so that the speed of vehicle is held approximately constant when there is no consistent change in the angular position of the accelerator pedal and the speed of vehicle changes quickly as the rate of change of the angular position of the accelerator pedal increases.

8 Claims, 9 Drawing Figures

SYSTEM AND METHOD FOR CONTROLLING THE OPENING ANGLE OF A THROTTLE VALVE ACCORDING TO THE POSITION OF AN ACCELERATOR FOR AN AUTOMOTIVE VEHICLE

BACKGROUND OF THE INVENTION

1. Field of the Invention

The present invention relates to a system and method for controlling the opening angle of a throttle valve located within a throttle chamber of an intake air passage of an engine according to the position of an accelerator member of an automotive vehicle.

2. Description of the Prior Art

The kind of system described above is exemplified by a Japanese Patent Application Unexamined Open No. Sho. 59-58131.

In the system disclosed in the above-identified document, changes in the opening of the throttle valve are controlled so as to be greatly magnified as compared with changes in the position of the accelerator.

In the above-described conventional system, however, vehicle speed is sensitive to even minute changes in accelerator position. Therefore, it is difficult to hold the vehicle speed constant.

SUMMARY OF THE INVENTION

With the above-described problem in mind, it is an object of the present invention to provide a system and apparatus for controlling the opening angle of a throttle valve according to the operating position of an accelerator, in which changes in the opening angle of the throttle valve are controlled so as to be magnified relative to the rate of change of the operating position of the accelerator and at the same time the vehicle speed can be held approximately constant when displacement of accelerator pedal is not great. This can be achieved by providing a system for controlling an opening angle of a throttle valve installed within an engine of a vehicle, comprising (a) first means for detecting the operating position of an accelerator member of the vehicle and outputting a signal indicative thereof, (b) second means for determining whether the accelerator member has been operated so as to hold the vehicle speed approximately constant on the basis of the behavior of the signal derived by the first means, and (c) third means for adjusting the opening angle position of the throttle valve to such a degree that the vehicle speed remains approximately constant when the second means determines that the accelerator member has been operated so as to hold the vehicle speed approximately constant and such that the rate of change of the opening angle position of the throttle valve is greater that the rate of change of position of the accelerator member otherwise.

BRIEF DESCRIPTION OF THE DRAWINGS

A more complete understanding of the present invention may be obtained from the following detailed description taken in conjunction with the attached drawings and in which.

DETAILED DESCRIPTION OF THE PREFERRED EMBODIMENTS

Reference will hereinafter be made to the drawings in order to facilitate understanding of the present invention.

Figure 1:
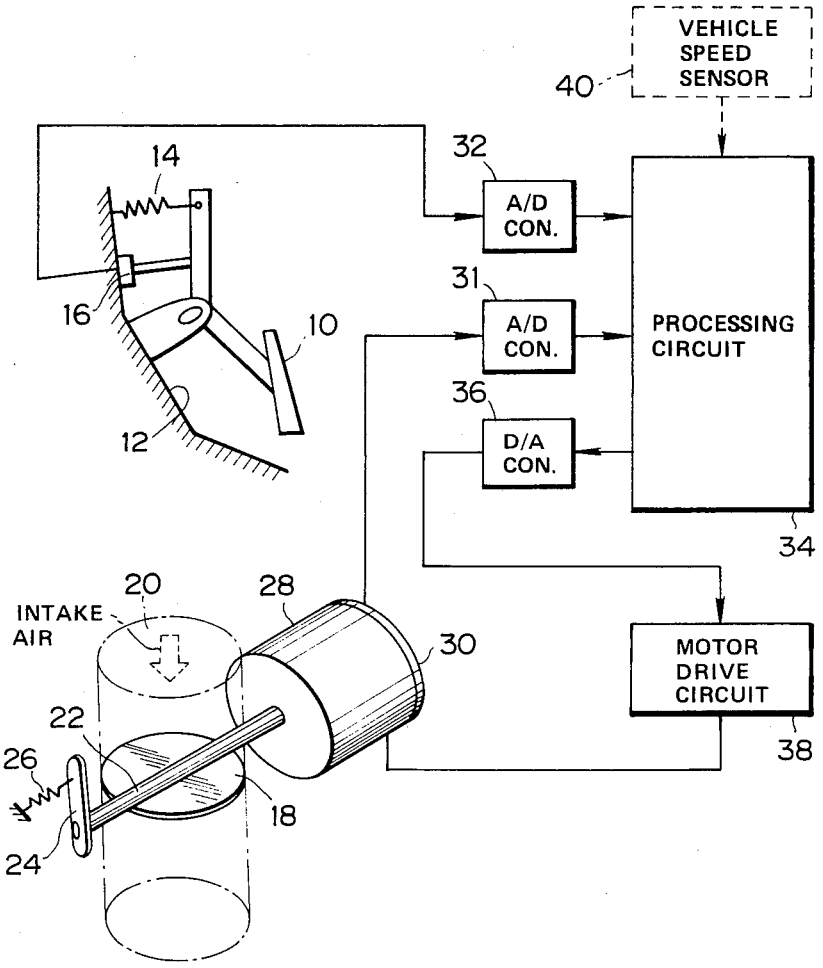
FIG. 1 is a simplified block diagram of a system for controlling the angular displacement of a throttle valve according to the operating position of an accelerator in a first preferred embodiment according to the present invention.

FIG. 1 shows diagrammatically the whole system according to the present invention.

In FIG. 1, the operating position (, i.e., the angular displacement through which, e.g., a driver depresses an accelerator pedal) of an accelerator 10, i.e., accelerator pedal is detected by means of a stroke detecting means such as a potentiometer 16. It should be noted that the accelerator pedal 10 is axially supported on a floor panel 12 of the vehicle and is biased in the counterclockwise direction as viewed in FIG. 1 by means of a return spring 14. A throttle valve 18 is installed within a throttle chamber of an intake air passage of an engine and is not mechanically linked with the accelerator pedal 10.

A rotational axis 22 of the throttle valve 18 is biased toward the fully-closed position of the throttle valve 18 by means of a return spring 26 via a lever 24. The angular displacement of the throttle valve 18 is controlled by means of a motor 28 and the angular position of the throttle valve 18 is detected by means of a potentiometer 30.

The output signals of the potentiometers 30, 16 are sent to a processing circuit 34 via A/D (analog-to-digital) converters 31, 32. On the basis of the received signals, the processing circuit 34 derives a control signal for controlling the throttle valve. This control signal is sent to a motor drive circuit 38 via a D/A (digital-to-analog) converter 36. The motor drive circuit 38 activates and controls the rotation of the motor 28 so that the throttle valve 18 is opened or closed according to actuation of the accelerator pedal 10.

The processing circuit 34 comprises a microcomputer. The operation of the first preferred embodiment will be described with reference to FIGS. 2(A) and 2(B). The processing routine shown in FIGS. 2(A) and 2(B) is activated at a predetermined period by means of an operating system (not shown) usually stored in a ROM (Read Only Memory) which is part of the microcomputer.

In a step 100, the depression $l_1$ (angular position) of the accelerator pedal recorded in the last execution cycle of this routine as the previous value is stored as the depression value $l_2$ from two samples ago. In a step 102, the depression value $l_0$ of the accelerator pedal sampled in the execution cycle immediately prior to the current routine cycle is stored as the previous depression value $l_1$.

In a step 106 shown in FIG. 2(A), the current depression of the accelerator pedal 10 is sampled and recorded as the current depression value $l_0$.

In a step 108, the current change in position $L_0$ of the accelerator pedal 10 from the previous to the current routine cycle is calculated by subtracting the previous depression value $l_1$ from the current depression value $l_0$. In a step 110, the prior change $L_1$ in the position of the accelerator pedal is obtained by subtracting the two samples old depression value $l_1$ from the previous depression value $l_2(L_1=l_1-l_2)$.

In steps 112 and 114, the processing circuit 34 determines whether the accelerator pedal 10 has been consistently actuated in the depression direction over the last two execution cycles on the basis of these change values $L_0$ and $L_1$. In other words, if both change values $L_0$, $L_1$ are positive when checked in steps 112, 114, respectively, the processing circuit 34 recognizes that the accelerator pedal 10 has been depressed for the last two execution cycles, and control passes to a step 118. Conversely, the processing circuit 34 determines that the accelerator pedal 10 is being consistently released when the values $L_0$, $L_1$ are both negative when checked in the steps 112 and 114, and in this case, control passes to a step 146, as will be explained later.

In a step 118, the offset L of the accelerator pedal 10 from a reference position $l_{00}$ is calculated by subtracting the reference position value $l_{00}$ from the current position value $l_0$.

Figure 3:
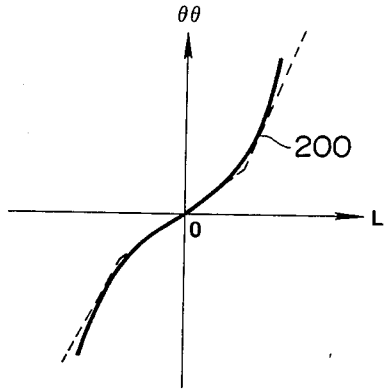
FIGS. 3, 4, 5, and 6 are characteristic graphs for use of explaining the operation of the first preferred embodiment shown in FIG. 1.

In subsequent step 120, the desired change in the opening angle of the throttle valve corresponding to the offset value L is derived from a characteristic curve 200, which is substantially a cubic curve, shown in FIG. 3 (the curve shown in FIG. 3 is prepared in the form of a map lattice and therefore a table look-up technique is used). When the desired change in the opening angle of the throttle valve $\theta\theta$ is added to the prior target value $\theta_1$ of the throttle valve in a step 122, the current target value $\theta_0$ of the opening angle of the throttle valve 18 results.

Figure 4:
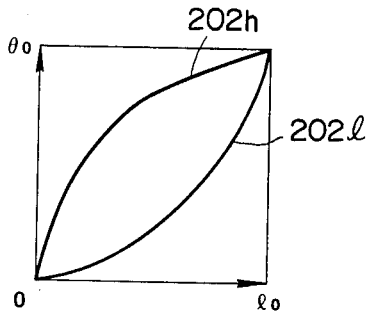

In steps 124 and 126, upper and lower limit values $\theta_h$ and $\theta_l$ of the target value $\theta_0$ for the opening angle of the throttle valve are calculated from the characteristic curves 202h, 202l shown in FIG. 4. The target value $\theta_0$ of the opening angle of the throttle valve is compared with these limit values $\theta_h$, $\theta_e$ in respective steps 128, 130. If the target value $\theta_0$ of the throttle valve opening angle exceeds the upper limit value $\theta_h$ (positive result in the step 128) or if the target value $\theta_0$ is below the lower limit value $\theta_l$, the target value $\theta_0$ of the opening angle of the throttle valve is forcibly set to the closer of these values $\theta_h$, $\theta_l$ in a step 132 or 134. If the target value $\theta_0$ of the throttle valve lies between these values $\theta_h$ and $\theta_l$, the value $\theta_0$ remains unchanged in a step 136.

Once the target value $\theta_0$ of the opening angle of the throttle valve 12 is calculated, the actual opening angle $\theta_r$ of the the throttle valve 18 is read in a step 138. The deviation $\epsilon$ of the actual opening angle $\theta$ from the target value $\theta_0$ is calculated in a step 140.

Figure 5:
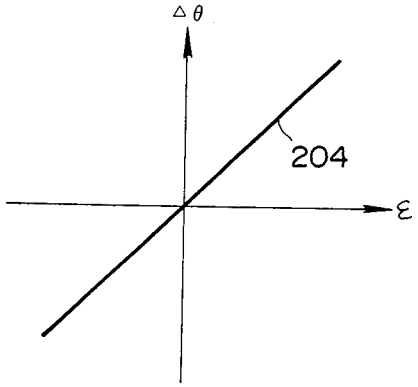

A control value for the opening angle $\Delta\theta$ is calculated from a characteristic curve 204 shown in FIG. 5 (The characteristic curve 204 is prepared in the form of a map grid.). The calculated control value for the opening angle $\Delta\theta$ is sent to the motor drive circuit 38 via the D/A converter 36 in a step 144.

Consequently, the opening angle of the throttle valve 18 is controlled in a direction which accords with the target opening angle $\theta_0$. When the accelerator pedal 10 is being operated consistently depressed or released, the processing circuit 34 recognizes that the vehicle is to be accelerated or decelerated and the vehicle driver does not intend to hold the vehicle speed constant. Therefore, the throttle valve 18 is opened or closed so that the vehicle is accelerated or decelerated.

Figure 6:
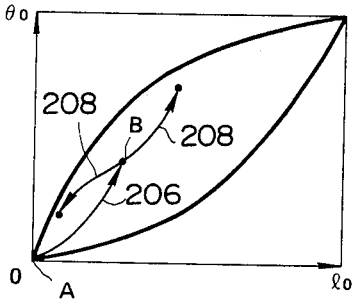

For example, in the case where the accelerator pedal 10 is continuously depressed from a starting point A, the throttle valve is opened in accordance with the characteristic curve 206 shown in FIG. 6 and the vehicle accelerates. The operation of the preferred embodiment will be described in cases where the driver works the accelerator pedal 10 so as to hold the vehicle speed constant.

In the preferred embodiment, the processing circuit 24 recognizes that the driver works the accelerator pedal 10 so as to hold the vehicle speed constant in cases where the accelerator pedal 10 is first depressed, and then held in place or released (negative result in the step 112 and positive result in the step 116), and in cases where the accelerator pedal 10 is first held in place or released and then depressed (positive result in the step 112 and negative result in the step 114). In these cases, the current depression value $l_0$) is taken as the reference depression value $l_{00}$ (step 146). It is noted that, also in the step 146, a target value $\theta_0$ of the opening angle of the throttle valve derived in the previous routine cycle is stored as a prior target value $\theta_1(\theta_1 \leftarrow \theta_0)$. Therefore, since the offset value L will be calculated to be zero in step 118, the position of the throttle valve 18 will not be adjusted.

Since the offset value L ($l_{00}$) is updated in each execution cycle, the throttle valve 18 is controlled in accordance with the operation of the accelerator pedal 10.

It should be noted that the characteristic curve 200 is substantially a cubic curve as appreciated from FIG. 3 and hence the rate of increase or decrease in the opening angle is small in the region of small positive or negative offsets L and the rate of increase or decrease in the opening angle increases as the absolute value of offset L increases. As an alternative, the characteristic curve may be approximated by three straight lines denoted by the dotted lines in FIG. 3.

Therefore, once the driver works the accelerator pedal so as to hold the vehicle speed constant, the gain in response of the opening angle of the throttle valve to changes in accelerator position is reduced, since initial offset values L will be relatively small. This prevents abrupt and unnecessary variations in vehicle speed and allows vehicle speed to be held constant.

If the driver depresses or releases the accelerator pedal 10 far enough and long enough, the throttle valve 18 will open wide or shut down quickly so that a sufficient acceleration or deceleration of the vehicle can be achieved.

For example, assuming the vehicle has accelerated to the operating point B in FIG. 6 and then the accelerator is actuated so as to hold the vehicle speed constant, the throttle valve 18 will subsequently be controlled to open or close in accordance with the characteristic curve 208 from the stable operating point B. Vehicle acceleration will be sufficient and, on the other hand, the vehicle speed can easily be held constant.

Figure 7:
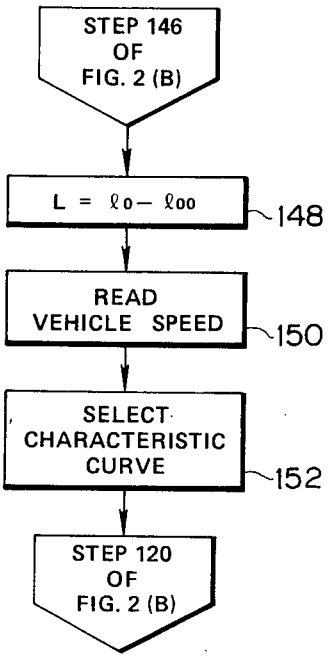
FIG. 7 is another operational flowchart for explaining the operation of a second preferred embodiment, the construction of which is the same as shown in FIG. 1.

FIG. 7 shows an operational flowchart for a second preferred embodiment. The construction of the second preferred embodiment is substantially the same as the first preferred embodiment shown in FIG. 1. However, a vehicle speed sensor 40 enclosed in dotted lines in FIG. 1 is added to the apparatus in the second embodiment.

In FIG. 7, illustrates a modification to sequence of steps 146–118. Since the steps other than steps 148 through 154 in FIG. 7 have already been described with reference to FIGS. 2(A) and 2(B), detailed description thereof will be omitted.

Figure 2:
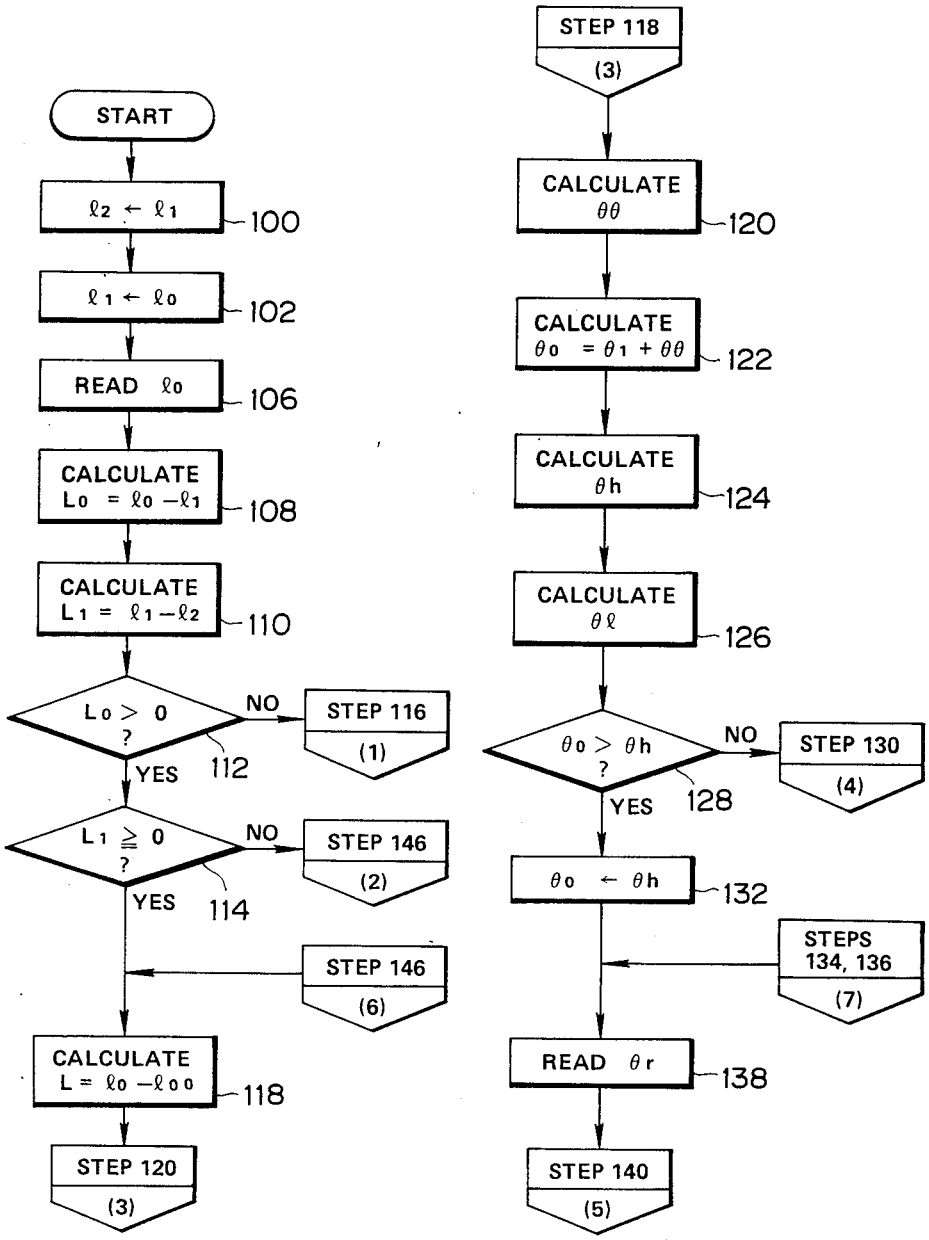
FIGS. 2(A) and 2(B) are integrally an operational flowchart for explaining the operation of the first preferred embodiment shown in FIG. 1.
Figure 2:
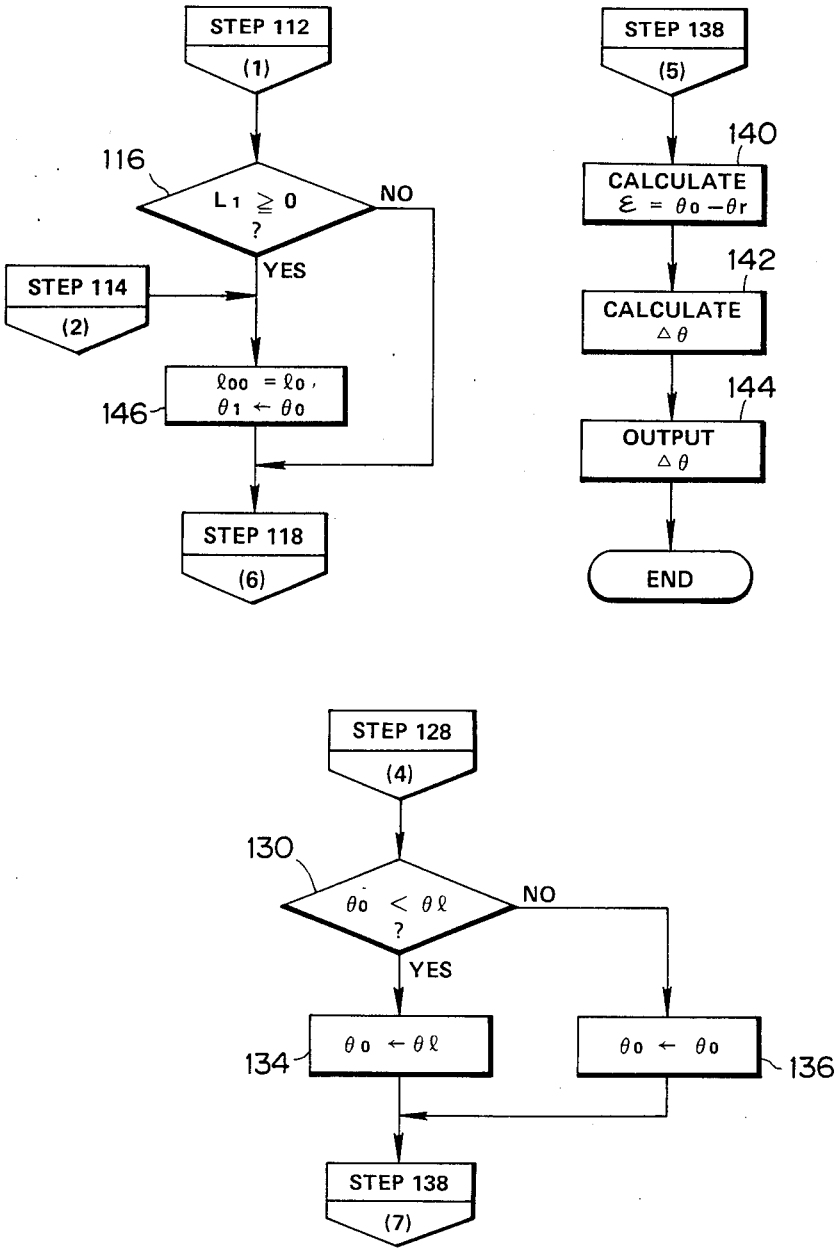

In the step 148, the processing circuit 34 calculates the relative amount of depression L by subtracting the reference depression value $l_{00}$ from the current depression value $l_0$, just as in step 118 of FIG. 2.

In the step 150, the vehicle speed is read from the vehicle speed sensor 40.

Figure 8:
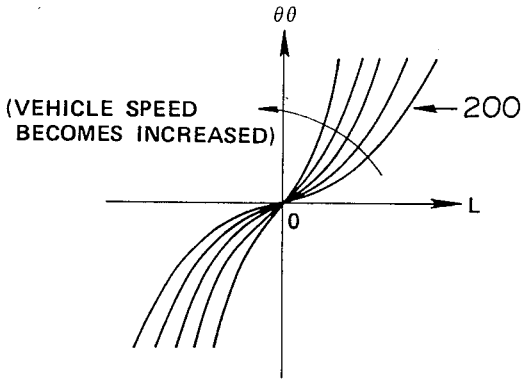
FIG. 8 is a characteristic graph for explaining the operation of the second preferred embodiment together with FIGS. 4, 5, and 6.

One of characteristic curves 200 shown in FIG. 8 is selected on the basis of the read vehicle speed in a step 152. In this regard, the characteristic curves with the steeper gradients are selected at higher vehicle speeds.

In the subsequent step 120, the change $\theta\theta$ in the opening angle of the throttle valve is calculated using the relative amount of depression L as described previously. The steps following step 120 are the same as shown in FIGS. 2(A) and 2(B).

Since, in this embodiment, the rate change $\theta\theta$ of the opening angle of the throttle valve relative to the accelerator position offset L is related to vehicle speed directly, more favorable vehicle acceleration and deceleration characteristics are achieved both at high and low vehicle speeds.

As described hereinabove, since in the system and method for controlling the angular displacement of the throttle valve according to the operating position of the accelerator according to the present invention, sufficient acceleration or deceleration force of the vehicle can be achieved while at the same time allowing vehicle speed to be easily held constant. Therefore, an appropriate engine control can be achieved according to a driving state of the vehicle.

It will clearly be understood by those skilled in the art that the foregoing description is made in terms of the preferred embodiments and various changes and modifications may be made without departing from the scope of the present invention which is to be defined by the appended claims.

What is claimed is:

1. A system for controlling an opening angle of a throttle valve installed within an engine of a vehicle, comprising:

(a) first means for detecting the operating position of an accelerator member of the vehicle and outputting a signal indicative thereof;

(b) second means for determining whether the accelerator member has been held at a relatively constant depressed position so as to hold the vehicle speed approximately constant on the basis of the behavior of the signal derived by said first means; and (c) third means for adjusting the opening angle position of the throttle valve to such a degree that the vehicle speed remains approximately constant when said second means determines that the accelerator member has been held at a relatively constant depressed position so as to hold the vehicle speed approximately constant and such that the incremental change in the opening angle position of throttle valve per incremental change in depressed position of said accelerator member is increased as the difference between the current accelerator member position and the last relatively constant depressed position of the accelerator member becomes greater.

2. The system according to claim 1, wherein said second means determines that the accelerator member has been held at a relatively constant depressed position so as to hold the vehicle speed approximately constant when there is no detectable change in the angular position of the accelerator member over a unit time.

3. The system according to claim 1, wherein said second means determines that the accelerator member has been held at a relatively constant depressed position so as to hold the vehicle speed approximately constant when the direction of change of the angular position of the accelerator member changes within a given unit of time.

4. A system for controlling an opening angle of a throttle valve installed within an engine of a vehicle, comprising:

(a) first means for detecting the operating position of an accelerator member of the vehicle and outputting a signal indicative thereof;

(b) second means for determining whether the accelerator member has been operated so as to hold the vehicle speed approximately constant on the basis of the behavior of the signal derived by said first means; and (c) third means for adjusting the opening angle position of the throttle valve to such a degree that the vehicle speed remains approximately constant when said second means determines that the accelerator member has been operated so as to hold the vehicle speed approximately constant and such that the rate of change of the opening angle position of the throttle valve is greater than the rate of change of position of the accelerator member otherwise, wherein said third means comprises: (a) fourth means for calculating the current rate of change of the angular position of the accelerator member per unit time: (b) fifth means for calculating the difference between rates of change of the angular position measured in successive units of time (c) sixth means for deriving a desired rate of change of the opening angle of the throttle valve with respect to time as a substantially cubic function of said difference calculated by said fifth means; (d) seventh means for calculating a target opening angle of the throttle valve on the basis of the desired rate of change of the opening angle of the throttle valve derived by said sixth means; (e) eighth means for detecting the angular position of the throttle valve and outputting a signal indicative thereof; and (f) ninth means for producing a signal indicating an opening angle offset value of the throttle valve on the basis of the current target opening angle calculated by said seventh means and the actual opening angle detected by said eighth means.

5. The system according to claim 4, wherein said third means further comprises a vehicle speed sensor for detecting the speed of the vehicle and wherein said sixth means further comprises tenth means for selecting one of the substantially cubic functions of said difference calculated by said fifth means according to the detected vehicle speed by said vehicle speed sensor.

6. The system according to claim 5, wherein said tenth means selects one of the cubic functions which has sharper cubic curve as the vehicle speed detected by the vehicle speed sensor increases.

7. A method for controlling an opening angle of a throttle valve installed within an engine of a vehicle comprising the steps of:

(a) detecting an operating position of an accelerator member of the vehicle and outputting a signal indicative thereof;

(b) determining whether the accelerator member has been operated so as to hold the vehicle speed approximately constant on the basis of the behavior of the signal derived in said step (a);

(c) calculating a current rate of change of the angular position of the accelerator member per unit time;

(d) calculating a difference between rates of change of the angular position measured in successive units of time;

(e) deriving a desired rate of change of the opening angle of the throttle valve with respect to time as a substantially cubic function of said difference calculated in step (d);

(f) calculating a target opening angle of the throttle valve on the basis of the desired rate of change of the opening angle of the throttle valve derived in step (e);

(g) detecting the angular position of the throttle valve and outputting a signal indicative thereof;

(h) producing a signal indicating an opening angle offset value of the throttle valve on the basis of the current target opening angle calculated in step (f) and the actual opening angle detected in step (g); and (i) adjusting the opening angle of the throttle valve on the basis of the signal produced in step (h).

8. A method, comprising:

(a) detecting the operating position of an accelerator member of a vehicle powered by an engine with a throttle valve and outputting a signal indicative thereof;

(b) determining whether the accelerator member has been held at a relatively constant depressed position so as to hold the vehicle speed approximately constant on the basis of the behavior of the signal derived in step (a);

(c) determining a difference between the current accelerator position and the last relatively constant depressed position of the accelerator pedal; and (d) adjusting an opening angle position of the throttle valve to such a degree that the vehicle speed remains approximately constant when it is determined in step (b) that the accelerator member has been held at a relatively constant position so as to hold the vehicle speed approximately constant and such that the incremental change in opening angle position of the throttle valve per incremental change in position of said accelerator member is increased as the difference between the current accelerator member position and the last relatively constant depressed position of the accelerator member becomes greater.

* * * * *